US005596336A

United States Patent [19]

Liu

[11] Patent Number: 5,596,336

[45] Date of Patent: Jan. 21, 1997

[54] LOW PROFILE TEM MODE SLOT ARRAY ANTENNA

[75] Inventor: Chung C. Liu, Rancho Palos Verdes, Calif.

[73] Assignee: TRW Inc., Redondo Beach, Calif.

[21] Appl. No.: 488,345

[22] Filed: Jun. 7, 1995

[51] Int. Cl.[6] ..... H01Q 13/10

[52] U.S. Cl. ..... 343/770; 343/700 MS; 343/756

[58] Field of Search ..... 343/700 MS, 769, 343/770, 771, 756, 904; 333/137, 208, 81 B

[56] References Cited

U.S. PATENT DOCUMENTS

| | | | |
|---|---|---|---|
| 3,599,216 | 8/1971 | Paine | 343/853 |
| 4,716,415 | 12/1987 | Kelly | 343/770 |
| 4,926,189 | 5/1990 | Zaghloul et al. | 343/700 MS |
| 4,929,959 | 5/1990 | Sorbello et al. | 343/700 MS |
| 5,043,738 | 8/1991 | Shapiro et al. | 343/700 MS |
| 5,173,714 | 12/1992 | Arimura et al. | 343/770 |
| 5,212,461 | 5/1993 | Aicardi et al. | 333/137 |
| 5,241,321 | 8/1993 | Tsao | 343/700 MS |
| 5,453,751 | 9/1995 | Tsukamoto et al. | 343/700 MS |
| 5,467,100 | 11/1995 | Chen | 343/770 |

OTHER PUBLICATIONS

U.S. Patent Application No. 08/104460 filed Aug. 9, 1993, now U.S. Patent 5,467,100.

*Primary Examiner*—Donald T. Hamec
*Assistant Examiner*—Tan Ho
*Attorney, Agent, or Firm*—Michael S. Yatsko

[57] ABSTRACT

A low profile slot antenna is provided which includes first and second oppositely disposed metallic plates with a dielectric layer disposed therebetween. An array of horizontal and vertical radiating elements are formed in the first metallic plate. An array of horizontal coupling slots and an array of vertical coupling slots are formed in the second metallic plate. The antenna further includes a planar feed network electrically coupled to the coupling slots. The feed network is connected to a conductive waveguide tube located at the central portion of the antenna. Orthogonal probes couple the waveguide tube to a transceiver. Accordingly, the slot antenna may operate to transmit and receive linearly polarized energy. The antenna may further include a polarization converter for converting between linear and circular polarization so as to allow for antenna operation with single or dual circular polarization energy. The polarization converter may include a pair of Meanderline polarizer sheets disposed above the metallic plates, or alternately may include use of a ninety degree hybrid coupler.

20 Claims, 5 Drawing Sheets

LOW PROFILE TEM MODE SLOT ARRAY ANTENNA

BACKGROUND OF THE INVENTION

1. Technical Field

The present invention relates generally to a slot antenna and, more particularly, to a low profile dual polarization slot array antenna which is capable of providing dual circular or linear polarization radiation with optimum efficiency and bandwidth.

2. Discussion

Direct communication systems commonly employ antennas for transmitting and receiving radiating energy between remote locations. Currently, antennas are widely employed for an increasing number of applications, many of which require a low profile, wide bandwidth antenna that can operate with polarized radiating energy. For example, advanced Direct Broadcast Systems (DBS) have been and are still being developed for future generation cable television transmission. Currently, North America Direct Broadcast Systems are being developed which transmit circular polarized (CP) energy. According to current specifications, these broadcast systems require low cost dual circular polarization eighteen inch aperture antennas at remote television locations for receiving the circular polarized radiating signals via satellite transponders.

In the past, conventional reflector antennas were commonly used which typically consisted of a reflector operatively coupled to a feed horn (polarizer) via a strut and an associated mounting structure. Such antennas include a Cassegrain antenna in which the feed horn is displaced from the reflector at a focal point on the front side thereof. However, such conventional reflector antennas generally occupy a relatively large volume and are easily susceptible to damage from the environment.

Low profile antenna concepts have been developed which include planar slot antennas. One type of slot antenna includes a double-layer structure which forms two propagation layers. Double-layer slot antennas historically have included the excitation of a transverse-electromagnetic (TEM) mode travelling wave between a pair of parallel metallic plates. This type of slot antenna further involves radio frequency (RF) energy leakage through radiating slots formed on the upper metallic plate so as to form a boresight pencil beam. Such slot antennas have generally exhibited a relatively simple mechanical structure with potentially low fabrication costs. However, there are recognized limitations associated with the conventional slot antenna approaches. These limitations include the fact that either single feed designs or overly complicated multiple feed designs are generally employed to excite a pure TEM mode travelling wave between the parallel plates. While a number of feed design approaches have been proposed, the prior concepts are generally limited to a single polarization (CP or linear) or involve high complexity and exhibit low efficiency with a relatively narrow bandwidth.

Another type of slot antenna includes a radial line slot array antenna which has either a single or double layer structure with a plurality of coupling slots formed along a spiral pattern. An example of one such radial line slot antenna is described in U.S. Pat. No. 5,175,561 issued to Goto. Such single-layer slot antennas have been employed for Direct Broadcast Systems in Japan and are generally capable of operating with single polarization energy only. That is, the radial line slot array may handle only either right hand or left hand circular polarization. An additional feed on another layer could be added to the single layer radial line slot array to provide dual circular polarization beams. However, the two beams would be dependent upon each other and optimization of one would degrade the other. That means if one circular polarized beam is optimized, then the other circular polarized beam will likely exhibit rather poor performance. As a consequence, the radial line slot array generally is not capable of effectively handling the combination of both right hand and left hand circular polarization, while achieving reasonably acceptable bandwidth and performance criteria.

More recently, a low profile planar dual circular polarization slot array antenna has been developed which is described in U.S. patent application Ser. No. 08/104,460, filed Aug. 9, 1993, and entitled "Slot-Coupled Fed Dual Circular Polarization TEM Mode Slot Array Antenna", now U.S. Pat. No. 5,467,100. The aforementioned allowed Patent Application is assigned to the assignee of the present invention and is hereby incorporated by reference. The above disclosed slot antenna has a low profile assembly with a pair of oppositely disposed metallic plates dielectrically separated therebetween. An array of radiating elements are formed on one plate while an array of coupling slots are formed on the other plate. A first beamforming feed network communicates with an array of horizontal coupling slots, while a second beamforming feed network communicates with a vertical array of coupling slots. While the aforementioned slot antenna realizes several advancements over the conventional antennas such as a low profile assembly and efficient operation, the present invention is capable of providing increased compactness, enhanced efficiency with minimal feed line interference, among other advantages.

It is therefore desirable to provide for a low profile planar dual polarization slot array antenna which overcomes limitations which may be associated with the above-mentioned prior art approaches. More particularly, it is desirable to provide for a low profile slot antenna which realizes minimal signal interference and has a low profile assembly. It is further desirable to provide for a double-layered slot antenna which is capable of operating with both right hand and left hand circular polarization and involves relatively low fabrication costs and less complexity, while maintaining high efficiency and wide bandwidth capabilities. In addition, it is further desirable to provide for such a slot antenna which exhibits two circular polarized beams which are optimized independent of one another.

SUMMARY OF THE INVENTION

In accordance with the teachings of the present invention, a low profile slot antenna is provided which includes first and second oppositely disposed metallic plates with a dielectric layer disposed therebetween. An array of horizontal and vertical radiating elements are formed in the first metallic plate. An array of horizontal and vertical coupling slots are formed in the second metallic plate. The slot antenna further includes a feed network having an array of feed lines which couple to individual ones of the horizontal and vertical coupling slots so that RF energy may pass therebetween. The feed network is configured in a non-overlapping single plane with four sections, each of which couples signals to a conductive waveguide tube at or near the center of the feed network. A pair of orthogonal probes serve as input/output terminals between the waveguide tube and a transceiver. According to this arrangement, the slot antenna may operate to transmit and receive linearly polarized energy. The antenna may further include a polarization converter for converting between linear and circular polarization so as to allow for antenna operation with single or dual circular polarization energy. According to one embodiment, the polarization conversion may be achieved with two sheets of Meanderline polarizers disposed above the upper metallic plate. Alternately, a ninety degree hybrid coupler may be connected to the input/output terminals to provide polarization conversion between linear and circular polarization signals.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

Figure 1:
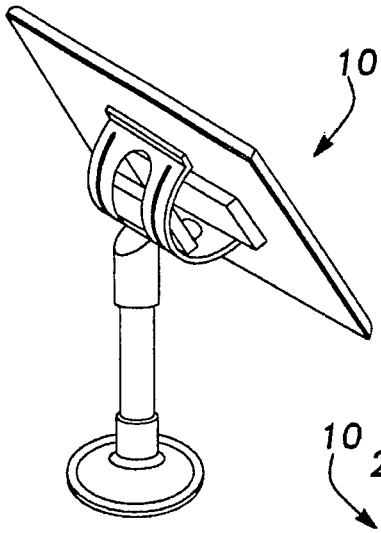
FIG. 1 is a view of a fully assembled low profile slot antenna according to the present invention.

Referring to FIGS. 1 through 4, a low profile slot array antenna 10 is shown therein in accordance with the present invention for handling dual polarization energy. As shown in FIG. 1, the slot antenna 10 has a low profile assembly with a thin planar energy radiation surface. The slot antenna 10 described hereinafter is designed to operate with transverse-electromagnetic (TEM) energy propagating within a pair of metallic plates. Further, the slot antenna is capable of transmitting and/or receiving both right hand and left hand circular polarized energy. Alternately, the slot array antenna 10 may be adapted to operate with linear (i.e., horizontal and vertical) polarization energy according to a second embodiment provided herein.

Figure 2:
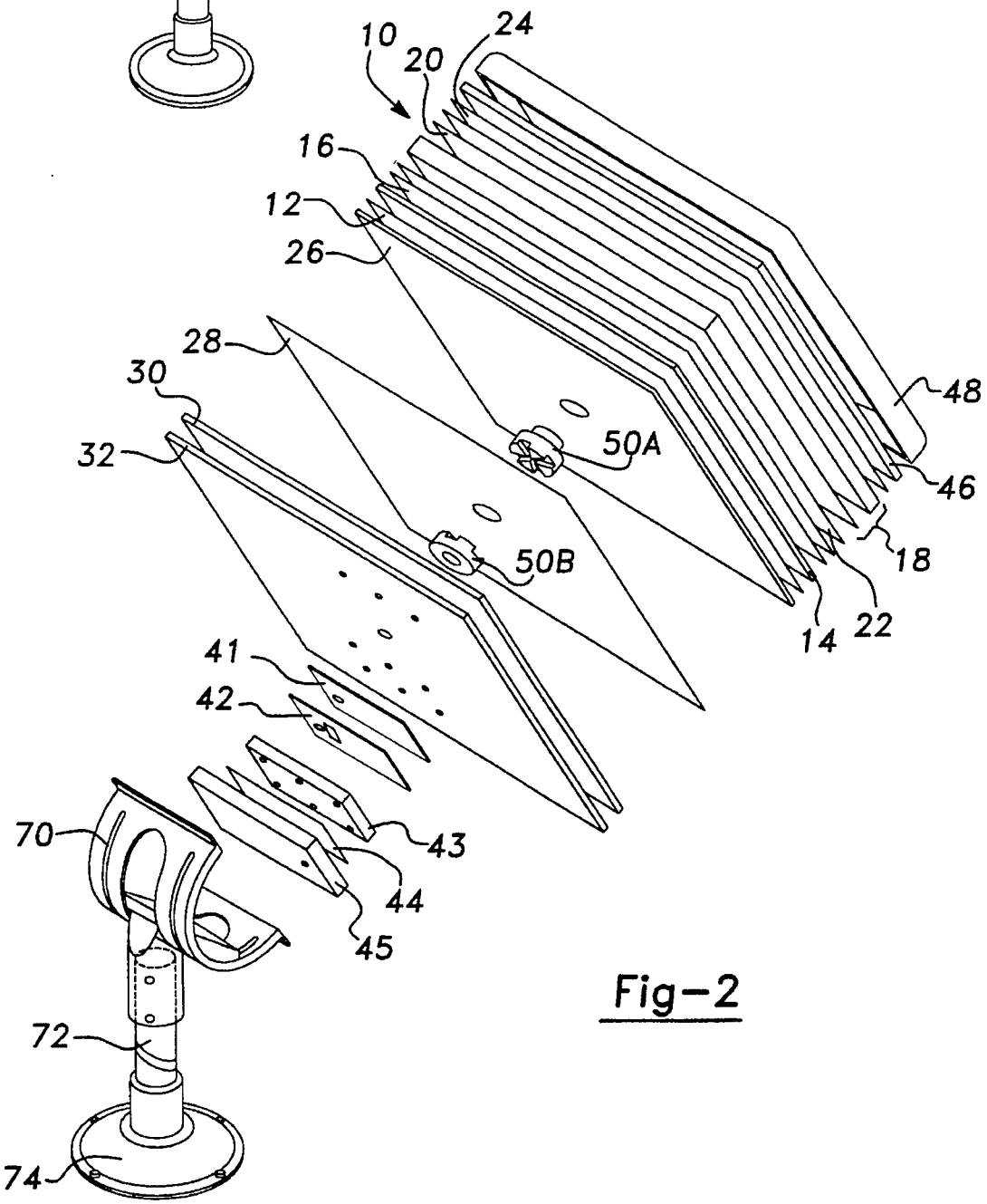
FIG. 2 is an exploded assembly view of the low profile slot antenna as shown in FIG. 1.
Figure 3:
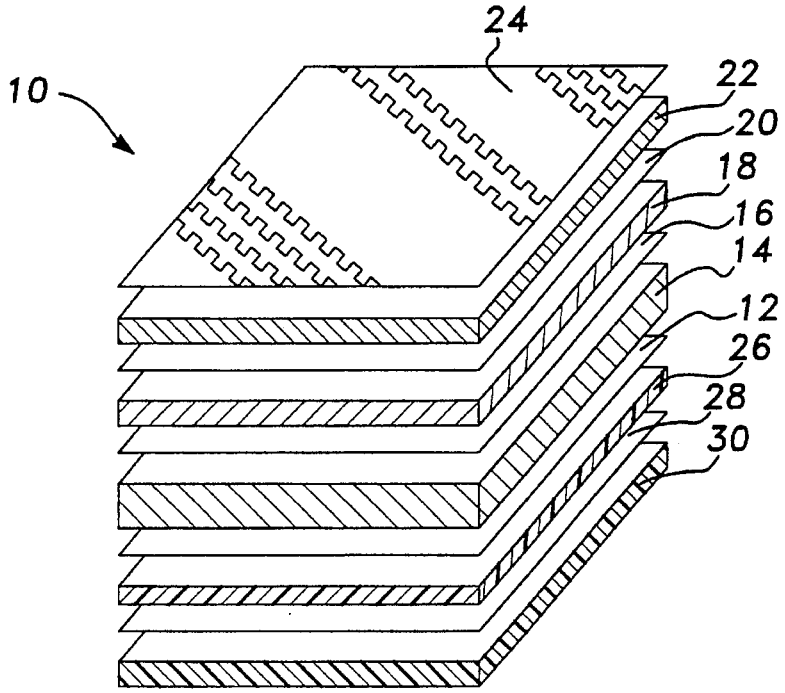
FIG. 3 is an exploded assembly view of a portion of the slot antenna shown in FIGS. 1 and 2 and taken from an elevated side view.
Figure 4:
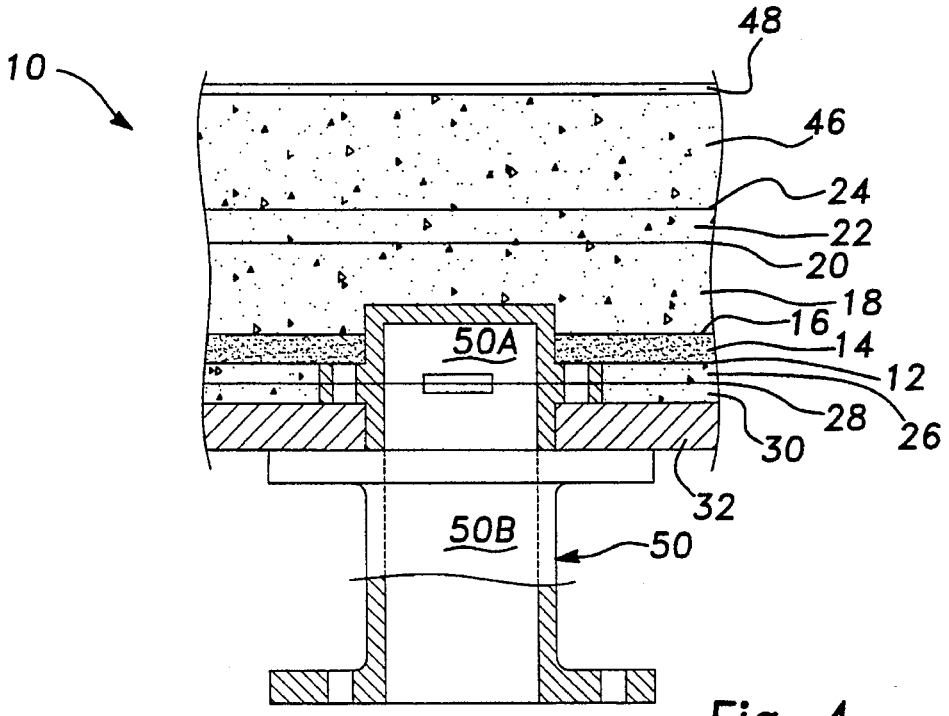
FIG. 4 is a partial cross-sectional view of the slot antenna according to the present invention.

With particular reference to FIGS. 2 through 4, the slot array antenna 10 generally includes a pair of oppositely disposed metallic plates 12 and 16 which are separated from one another via a layer of dielectric material 14. Dielectric layer 14 may generally have a dielectric constant of 1.1 or greater. The upper metallic plate 16 generally includes a plurality of vertical and horizontal radiating elements (slots) arranged in a two-dimensional array, while the lower metallic plate 12 has a plurality of horizontal and vertical coupling slots formed therein. According to this double-layer antenna structure configuration, the metallic plates 12 and 16 allow a transverse-electromagnetic (TEM) mode traveling wave to be excited therebetween. As a consequence, radio frequency (RF) energy horizontal and vertical components of the polarized radiation are able to penetrate the appropriate radiating elements and coupling slots. A feed network 28 is disposed below lower metallic plate 12 and configured to communicate with the coupling slots formed in plate 12. Additionally, a foam sheet 26 dielectrically separates feed network 28 from lower metallic plate 12.

The slot antenna 10 further includes a pair of Meanderline polarizer sheets 20 and 24 disposed above the upper metallic plate 16 and separated therefrom via a foam sheet 18. Another foam sheet 22 is further disposed between the lower and upper Meanderline polarizer sheets 20 and 24 for providing a separation distance therebetween. An outer front cover 48, preferably made of plastic or other non-conductive protective material, is disposed above Meanderline polarizer sheet 24 and separated therefrom via foam sheet 46. Similarly, a rear plate 32 is provided below the feed network 28 and is separated from network 28 via a foam sheet 30. Accordingly, radiating elements, coupling slots and the feed network 28 are sandwiched between front cover 48 and rear plate 32 and separated via dielectric foam sheets to provide a low profile planar radiation surface.

The slot antenna 10 has a conductive waveguide tube 50 protruding through the center portion of the antenna 10 extending from the bottom side through various layers into foam sheet 18. The conductive waveguide tube 50 carries signals between the feed network 28 and a transceiver as will be described herein. Waveguide tube 50 generally includes a top cap portion 50A and a bottom collar portion 50B which extends through layers 30 and 32 as well as a spacer layer 41. A circuit board 42 is disposed between the spacer layer 41 and a cover 43. The waveguide tube 50 communicates signals to and from conductive contacts on the circuit board 42. In addition to conductive contacts, the circuit board 42 may contain a transceiver, switching circuitry and signal traces as well as other electronic devices.

A supportive cover 45 and abutting O-ring 44 are secured behind cover 43. Further, slot antenna 10 has an antenna bracket 70 against which the rear plate 32 is mounted via bolts or other fastener devices. The antenna bracket 70 is connected to a mast assembly 72 which in turn is supported via a base member 74. Accordingly, slot antenna 10 is mounted and supported via the bracket 70, mast assembly 72 and base member 74.

Figure 5:
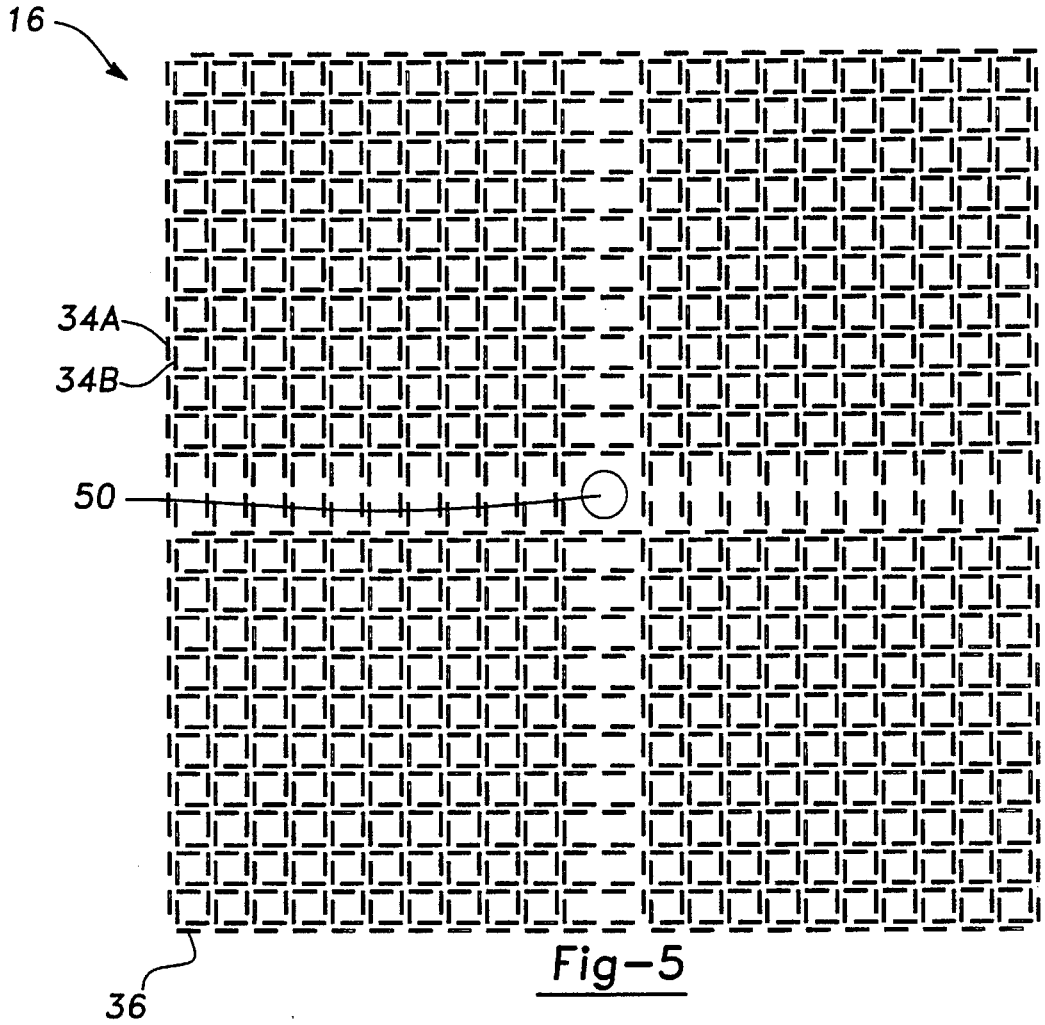
FIG. 5 is a top view of an upper metallic plate of the slot antenna containing an array of radiating elements.
Figure 6:
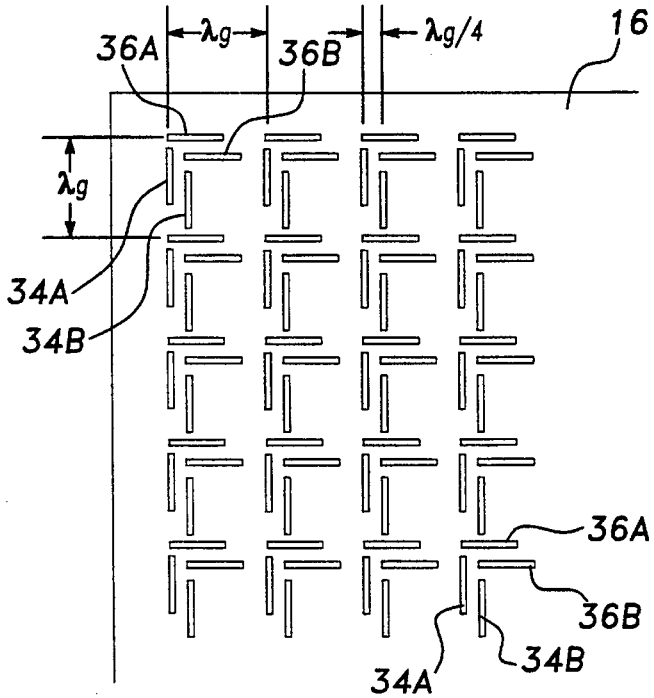
FIG. 6 is an enlarged top view of a portion of the upper metallic plate shown in FIG. 5 further illustrating the configuration of the radiating elements.

Turning now to FIGS. 5 and 6, the upper metallic plate 16 is shown containing an array of vertical radiating elements 34A and 34B and horizontal radiating elements 36A and 36B formed therein. The vertical and horizontal radiating elements 34A, 34B, 36A and 36B are essentially very thin slots which extend through upper metallic plate 16 and are formed in parallel pairs. As shown in FIG. 5, the array of radiating elements are configured in four equal quadrants generally centered about the conductive waveguide tube 50.

Each pair of vertical radiating elements 34A and 34B preferably has a vertical offset between the two radiating elements making up each corresponding pair. As illustrated in FIG. 6, the vertical offset is equal in distance to approximately one-quarter of a wavelength ($\frac{1}{4}\lambda_g$), where the wavelength $\lambda_g$ is that of the TEM energy propagating within metallic plates 12 and 16. Likewise, each pair of horizontal radiating elements 36A and 36B preferably has a horizontal offset equal to approximately one-quarter wavelength ($\frac{1}{4}\lambda_g$) of the TEM energy.

Adjacent pairs of vertical radiating elements 34A and 34B are displaced from each other the distance of about one wavelength $\lambda_g$ of the operating TEM energy. Similarly, adjacent pairs of horizontal radiating elements 36A and 36B are also displaced from each other the distance of about one wavelength $\lambda_g$. According to the arrangement of radiating elements shown, linear polarized energy is able to efficiently pass through the radiating elements 34 and 36. In doing so, the horizontal polarization component thereof passes through metallic plate 16 via the vertical radiating elements 34A and 34B, while the vertical polarization component of the linear polarized energy passes therethrough via the horizontal radiating elements 36A and 36B.

Each pair of radiating elements 34A, 34B, 36A and 36B are preferably designed to have a length that may vary in length from the other pairs. This is because the length of the radiating elements 34A, 34B, 36A and 36B are designed such that a uniform amplitude of energy is radiated or received so as to provide for maximum antenna aperture efficiency. Vertical radiating elements 34A and 34B which are in closer proximity to the corresponding vertical coupling slots on lower metallic plate 12 receive more energy and therefore have a shorter length, while the more distant radiating elements have a longer length to compensate for the lower amount of energy associated therewith. Horizontal radiating elements 36A and 36B likewise have the same dimensional variations. Accordingly, the array of vertical radiating elements 34A and 34B can essentially be designed and optimized independent of the horizontal radiating elements 36A and 36B.

Figure 7:
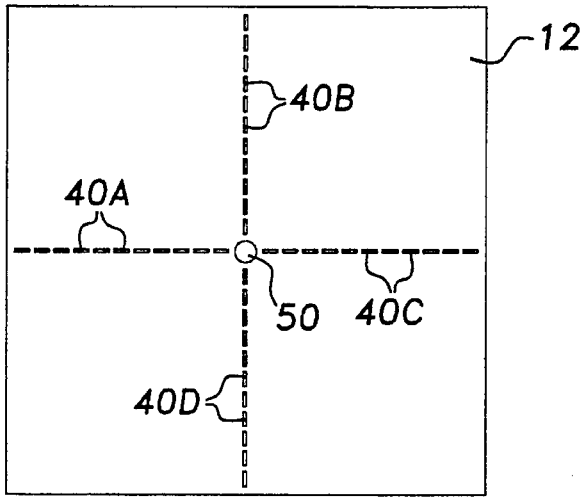
FIG. 7 is a top view of a bottom metallic plate of the slot antenna containing an array of coupling slots in accordance with the present invention.

The bottom metallic plate 12 is shown in FIG. 7 and has a horizontal N×1 array of rectangular coupling slots 40A and 40C and a vertical N×1 array of rectangular coupling slots 40B and 40D formed therein. The horizontal coupling slots 40A are shown on one side of waveguide tube 50, while the horizontal coupling slots 40C are provided on the opposite side. Similarly, vertical coupling slots 40B and 40D are provided on opposite sides of waveguide tube 50. The horizontal coupling slots 40A and 40C are arranged orthogonal to the vertical coupling slots 40B and 40D and are preferably centered about the conductive waveguide tube 50. The horizontal and vertical coupling slots 40A through 40D operate to either excite the respective vertical and horizontal polarization energy onto the stripline feed network 28 or receive energy therefrom.

The stripline feed network 28 is disposed below the lower metallic plate 12 and separated therefrom via a dielectric layer 26. The feed network 28 is fabricated on top surface of a dielectric material such as foam sheet 30 or fabricated on a separate dielectric sheet above foam sheet 30. A conductive ground plane is provided on the bottom side of foam sheet 30 or the separate dielectric sheet so as to form stripline circuitry making up the feed network 28.

Figure 8:
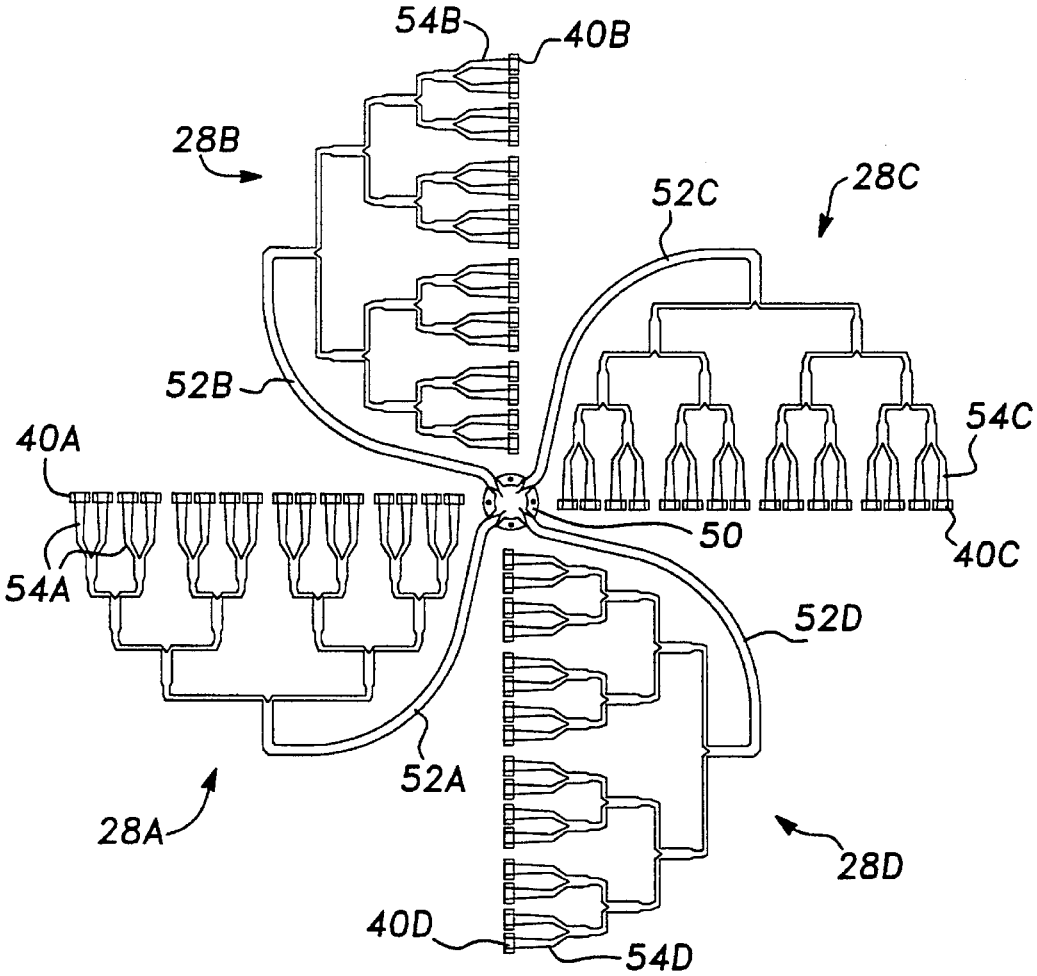
FIG. 8 is a schematic representation of a stripline feed network configured to cooperate with the array of coupling slots in accordance with the present invention.

A detailed illustration of the feed network 28 is shown in FIG. 8 in cooperation with the array of horizontal and vertical coupling slots 40A through 40D. The feed network 28 is preferably fabricated as stripline circuit traces with finger traces 54A through 54D which extend across a portion of individual ones of the horizontal and vertical coupling slots 40A through 40D. The feed network 28 is configured with four similar sections 28A through 28D oriented at ninety degree intervals about a circular rotation of the conductive waveguide tube 50. The first feed network section 28A has a feed line 52A coupled to the waveguide tube 50 located at the center of the feed network 28. Feed line 52A branches and splits in half several times to provide the array of fingers 54A, each of which electrically couples to individual ones of the horizontal coupling slots 40A. Similarly, each of the remaining feed network sections 28B through 28D has respective feed lines 52B through 52D center coupled to waveguide tube 50 and split several times to provide corresponding arrays of fingers 54B through 54D. Fingers 54B are electrically coupled to the vertical array of coupling slots 40B, while fingers 54C and 54D are electrically coupled to respective horizontal coupling slots 40C and vertical coupling slots 40D. The feed network 28 configuration of the present invention advantageously allows for the realization of single layer signal traces which do not overlap. Other single plane feed network configurations such as a travelling wave feed could be used in lieu of feed network 28 shown herein to further reduce feed loss. However, alternate feed network configurations may exhibit a reduced bandwidth.

Figure 9:
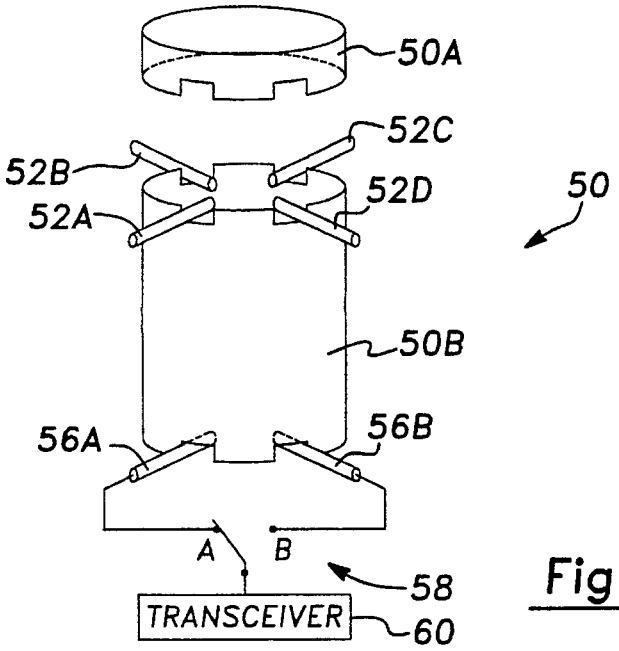
FIG. 9 illustrates a conductive waveguide tube centrally located within the slot antenna of the present invention.

During signal reception, energy radiates across vertical coupling slots 40A through 40D and excites a current onto the stripline circuit traces 54A through 54D. The currents on circuit traces 54A through 54D are fed through the individual sections of the feed network 28 to the waveguide tube 50 via feed lines 52A through 52D. Referring to FIG. 9, the conductive waveguide tube 50 is shown in greater detail. Feed lines 52A through 52D are physically and electrically coupled to the upper portion of collar 50B of tube 50. Feed lines 52A through 52D are coupled to tube 50 at ninety degree intervals.

Additionally, a pair of waveguide transducer probes 56A and 56B are physically and electrically coupled to the bottom portion of collar 50B of tube 50. The probes 56A and 56B serve as orthomode transducers (OMT) for collecting orthogonal signals. Various waveguide OMTs may be used for this purpose. First and second probes 56A and 56B are arranged orthogonal to one another (i.e., at a ninety degrees rotation) and serve as input/output terminals. According to this configuration, first probe 56A picks up one orthogonal polarization signal, while second probe 56B picks up the other orthogonal polarization signal. Probes 56A and 56B are coupled to an RF switch 58. More specifically, probe 56A is coupled to contact position A of switch 58, while probe 56B is coupled to contact position B of switch 58. Switch 58 in turn is coupled to a transceiver 60 or other electronic device. Accordingly, during signal reception received energy is fed through waveguide tube 50 and probes 56A and 56B and, depending on the position of switch 58, a linear component of polarized energy is fed to transceiver 60.

The feed network 28 may also function as a beamforming network and can be designed so as to provide the desired beam pattern of the slot antenna 10. The design criteria may include the proper selection of impedance throughout the stripline circuit trace 54 so as to control the amplitude of the signal excited across the associated coupling slots 40A through 40D.

Figure 10:
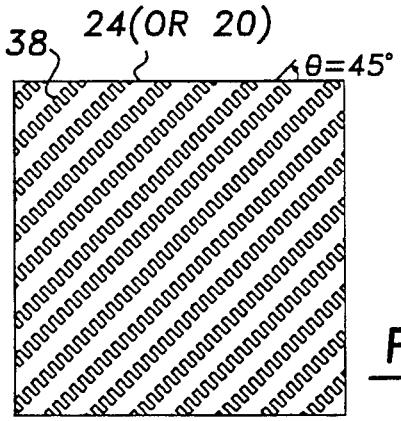
FIG. 10 is a schematic representation of a Meanderline polarizer sheet which may be used according to one embodiment.

Turning to FIG. 10, an example of one of the Meanderline polarizers 24 or 20 is shown therein. Each of the Meanderline polarizer sheets 20 and 24 are conventional polarizers which employ a square-wave printed-circuit pattern oriented at a forty-five degree angle to provide reactive loading to the orthogonal linear component of an electric field. Accordingly, each of the polarizer sheets 20 and 24 causes a differential electrical phase shift between two orthogonal fields. Thus, the two polarizer sheets 20 and 24 combined together provide a ninety degree phase differential of the orthogonal incident waves so as to provide a conversion between linear and circular polarization energy. Therefore, circular polarized energy is converted to a linear polarization as the energy passes through polarizer sheets 20 and 24, while linear polarization energy likewise is converted to circular polarization.

Figure 11:
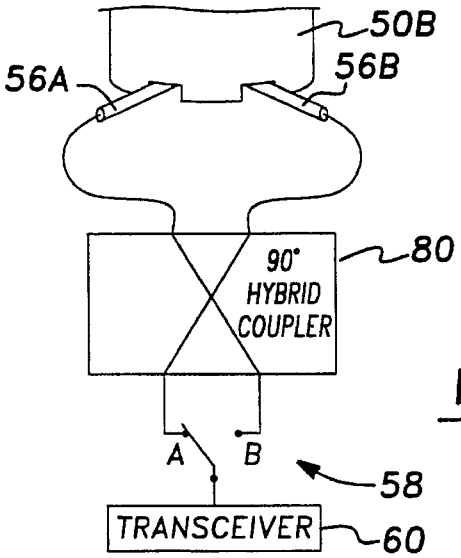
FIG. 11 illustrates the use of a ninety degree hybrid coupler for achieving polarization conversion according to an alternate embodiment.

In lieu of the two Meanderline polarizer sheets 20 and 24, the antenna 10 of the present invention may employ a ninety degree hybrid coupler 80 as shown in FIG. 11 according to an alternate embodiment. According to the alternate embodiment, the Meanderline polarizer sheets 20 and 24 are no longer used and the ninety degree hybrid coupler 80 is coupled between each of probes 56A and 56B and the RF switch 58. The ninety degree hybrid coupler 80 may be fabricated on the circuit board 42 along with transceiver 60 and switch 58. The coupler 80, like the Meanderline polarizer sheets 20 and 24, converts linear polarization energy to circular polarization energy and converts circular polarization energy to linear polarization energy.

With the use of the Meanderline polarizers 20 and 24, probes 56A and 56B will conduct vertical and horizontal components of linear polarization with the antenna transmitting or receiving circular polarization. However, with the alternate use of the hybrid coupler 80, circular polarization antenna transmission and reception will require the probes 56A and 56B to conduct two orthogonal linear components of circular polarization. The ninety degree hybrid coupler 80 may allow for cost savings and reduced size, while the Meanderline polarizer sheets 20 and 24 are generally capable of achieving better overall performance.

In operation, the slot antenna 10 may be employed to transmit and/or receive dual circular polarized energy according to one embodiment of the present invention. When receiving, radiating energy penetrates the upper and lower Meanderline polarizer sheets 24 and 20. Energy which has a circular polarization associated therewith is thereby converted to linear polarized energy which has either horizontal or vertical polarization components. The converted linear polarized energy is directed onto the upper metallic plate 16. The vertical radiating elements 34A and 34B in upper metallic plate 16 allow the horizontal component of linear polarization to penetrate therethrough in the form of a first set of linear polarized boresight beams. Likewise, the horizontal radiating elements 36A and 36B in metallic plate 16 operate to allow the vertical component of the linear polarization to penetrate therethrough in the form of a second set of linear polarized boresight beams.

The two sets of boresight beams are independent of one another and essentially propagate between the lower metallic plate 12 and the upper metallic plate 16. The RF energy from the boresight beams is then fed to the feed network 28 via the vertical and horizontal coupling slots 40A through 40D. For instance, the RF energy across vertical coupling slots 40A will excite a current onto the stripline circuits 54A which is coupled thereto. The received currents are then fed to the conductive waveguide tube 50 at the center of the antenna via the appropriate feed lines. The probes 56A and 56B couple energy to switch 58 which in turn is coupled to a transceiver 60 or other electronic radio-wave device.

The slot antenna 10 may likewise operate to transmit radiating energy which has a circular polarization associated therewith. During antenna transmissions, transceiver 60 transmits polarized energy through switch 58 to probes 56A and 56B. The transmit energy is fed through waveguide tube 50 to feed lines 52A through 52D and currents are induced on stripline circuit trace 54 which in turn excite radiating energy on coupling slots 40A through 40D. This in turn induces radiating TEM energy between metallic plates 12 and 16 and allows radiating energy to transmit via the radiating elements 34 and 36. The Meanderline polarizer sheets 20 and 24 convert the linear polarization to a circular polarization. The circular polarization energy thereafter radiates from the slot antenna 10 within the selected field of view.

The slot array antenna 10 is particularly desirable for use with the Direct Broadcast Systems (DBS) which are currently being developed to receive cable television broadcasts. According to this approach, the slot antenna 10 as described herein is a compact low profile device which may have physical dimensions of eighteen inches by eighteen inches with a depth of one and one-half inches. The slot antenna 10 therefore may easily be used by users as a cable television reception device which may easily be installed within the local vicinity of a television.

While the present invention has been described in connection with energy having a circular polarization, and with particular reference to use with Direct Broadcast Systems, the present invention may be employed in connection with a vast variety of other applications including military and space communication antenna systems. This includes operating with linear polarized signals according to a second embodiment of the present invention. In order to do so, the Meanderline polarizer sheets 20 and 24, or alternately the ninety degree hybrid coupler, may be -removed so as to allow for the direct transmission and reception of linear polarized energy. According to this alternate embodiment, the vertical and horizontal components of the linear polarization energy received from an external source are directly applied to the upper metallic plate 16 during reception, while such linear components are transmitted from antenna 10 during transmission.

In view of the foregoing, it can be appreciated that the present invention enables the user to achieve a low profile slot antenna which provides dual circular polarization capability. Thus, while this invention has been disclosed herein in connection with a particular example thereof, no limitation is intended thereby except as defined in the following claims. This is because a skilled practitioner recognizes that other modifications can be made without departing from the spirit of this invention after studying the specification and drawings.

What is claimed is:

1. A slot antenna comprising:

first and second oppositely disposed metallic plates spaced separate from one another via a dielectric medium, said first and second plates being adapted to allow transverse-magnetic energy to propagate therebetween;

an array of radiating elements formed in said first metallic plate;

an array of horizontal coupling slots and an array of vertical coupling slots formed in said second metallic plate, said array of horizontal coupling slots including a first array of horizontal coupling slots positioned relative to a common conductor and a second array of horizontal coupling slots positioned relative to the common conductor, said array of vertical coupling slots including a first array of vertical coupling slots positioned relative to the common conductor and a second array of vertical coupling slots positioned relative to the common conductor;

a feed network having an array of non-overlapping feed lines configured in a single plane and electrically coupled to said horizontal and vertical coupling slots, wherein a first array of feed lines electrically couple the first array of horizontal coupling slots to the common conductor, a second array of feed lines electrically couple the second array of horizontal coupling slots to the common conductor, a third array of feed lines electrically couple the first array of vertical coupling slots to the common conductor, and a fourth array of feed lines electrically couple the second vertical coupling slots to the common conductor; and radio-wave connecting means coupled to the feed network.

2. The antenna as defined in claim 1 wherein said common conductor is a centrally located waveguide tube.

3. The antenna as defined in claim 2 further comprising first and second probes connected to the waveguide tube, the first probe oriented substantially orthogonal to the second probe.

4. The antenna as defined in claim 1 wherein said feed network comprises stripline circuitry.

5. The antenna as defined in claim 1 further comprising polarization conversion means for converting energy between a linear polarization and a circular polarization.

6. The antenna as defined in claim 5 wherein said polarization means comprises a pair of oppositely disposed Meanderline polarizer sheets disposed above said metallic plates.

7. The antenna as defined in claim 1 wherein each of the horizontal and vertical coupling slots include a one dimensional array of rectangular slots which are separated from said feed network via a dielectric medium.

8. The antenna as defined in claim 1 wherein said radiating elements are formed in the horizontal and vertical arrays.

9. The antenna according to claim 1 wherein the horizontal coupling slots and the vertical coupling slots are positioned on the second metallic plate such that there is not a direct alignment between each of the radiating elements formed in the first metallic plate and the horizontal and vertical coupling slots.

10. The antenna according to claim 1 wherein the first array of horizontal coupling slots is positioned 90° from the first and second arrays of vertical coupling slots and the second array of horizontal coupling slots is positioned 90° from the first and second arrays of vertical coupling slots.

11. A slot antenna comprising:

first and second oppositely disposed metallic plates spaced separate from one another via a dielectric medium and adapted to allow transverse-electromagnetic energy to propagate therebetween;

an array of horizontal and vertical radiating elements formed in said first metallic plate;

an array of horizontal coupling slots and an array of vertical coupling slots formed in said second metallic plate, said array of horizontal coupling slots including a first array of horizontal coupling slots positioned on one side of a central conductor and a second array of horizontal coupling slots positioned on an opposite side of the central conductor, said array of vertical coupling slots including a first array of vertical coupling slots positioned on one side of the central conductor and a second array of vertical coupling slots positioned on an opposite side of the central conductor, wherein each of the horizontal and vertical coupling slots include a one dimensional array of rectangular slots which are separated from said feed network via a dielectric medium;

a feed network having an array of non-overlapping feed lines configured in a single plane and electrically coupled to said horizontal and vertical coupling slots, wherein a first array of feed lines electrically couple the first array of horizontal coupling slots to the central conductor, a second array of feed lines electrically couple the second array of horizontal coupling slots to the central conductor, a third array of feed lines electrically couple the first array of vertical coupling slots to the central conductor, and a fourth array of feed lines electrically couple the second vertical coupling slots to the central conductor; and radio-wave connecting means coupled to the central conductor.

12. The antenna as defined in claim 11 wherein said central conductor comprises a waveguide tube.

13. The antenna as defined in claim 12 further comprising a pair of orthogonal probes coupled to the waveguide tube.

14. The antenna according to claim 11 wherein the horizontal coupling slots and the vertical coupling slots are positioned on the second metallic plate such that there is not a direct alignment between the radiating elements formed in the first metallic plate and the horizontal and vertical coupling slots.

15. The antenna according to claim 11 wherein the first array of horizontal coupling slots is positioned 90° from the first and second arrays of vertical coupling slots and the second array of horizontal coupling slots is positioned 90° from the first and second arrays of vertical coupling slots.

16. The antenna according to claim 11 further comprising polarization conversion means for converting energy between a linear polarization and a circular polarization.

17. A dual circular polarization slot antenna comprising:

first and second oppositely disposed metallic plates spaced separate from one another via a dielectric medium and adapted to allow transverse-electromagnetic energy to propagate therebetween;

an array of horizontal and vertical radiating elements formed in said first metallic plate;

an array of horizontal coupling slots formed in said second metallic plate which cooperate with said horizontal radiating elements so that vertical polarized energy may pass through said horizontal radiating elements and coupling slots, said array of horizontal coupling slots including a first array of horizontal coupling slots positioned on one side of a central conductor and a second array of horizontal coupling slots positioned on an opposite side of the central conductor;

an array of vertical coupling slots formed in said second metallic plate which cooperate with said vertical radiating elements so that horizontal polarized energy may pass through said vertical radiating elements and coupling slots, said array of vertical coupling slots including a first array of vertical coupling slots positioned on one side of the central conductor and a second array of vertical coupling slots positioned on an opposite side of the central conductor;

a feed network having an array of non-overlapping feed lines configured in a single plane and electrically coupled to said horizontal and vertical coupling slots, wherein a first array of feed lines electrically couple the first array of horizontal coupling slots to the central conductor, a second array of feed lines electrically couple the second array of horizontal coupling slots to the central conductor, a third array of feed lines electrically couple the first array of vertical coupling slots to the central conductor, and a fourth array of feed lines electrically couple the second vertical coupling slots to the central conductor;

a conductive waveguide located near the center of the feed network and coupled to the central conductor;

orthogonal waveguide probes coupled to the waveguide;

radio-wave connecting means coupled to the waveguide probes; and polarization conversion means for converting radiating energy between a linear and circular polarization.

18. The antenna as defined in claim 17 wherein said polarization conversion means comprises a pair of oppositely disposed Meanderline polarizer sheets disposed above said metallic plates.

19. The antenna according to claim 17 wherein the horizontal coupling slots and the vertical coupling slots is positioned on the second metallic plate such that there is not a direct alignment between the radiating elements formed in the first metallic plate and the horizontal and vertical coupling slots.

20. The antenna according to claim 17 wherein the first array of horizontal coupling slots is positioned 90° from the first and second arrays of vertical coupling slots and the second array of horizontal coupling slots is positioned 90° from the first and second arrays of vertical coupling slots.

* * * * *